US006637066B1

(12) United States Patent
Chang

(10) Patent No.: US 6,637,066 B1
(45) Date of Patent: Oct. 28, 2003

(54) METHOD FOR MAKING COMFORTABLE BATHING SCRUBBER

(76) Inventor: Yun-Yi Chang, No. 664, San-Chiao Road, Sec. 2, Tien-Chung Chen, Chang-Hwa Hsien (TW)

( * ) Notice: Subject to any disclaimer, the term of this patent is extended or adjusted under 35 U.S.C. 154(b) by 13 days.

(21) Appl. No.: 10/126,380

(22) Filed: Apr. 17, 2002

(51) Int. Cl.[7] ..... A47K 7/02
(52) U.S. Cl. ..... 15/209.1; 15/229.11; 300/21
(58) Field of Search ..... 15/209.1, 229.11, 15/229.13; 300/21

(56) References Cited

U.S. PATENT DOCUMENTS 2,851,715 A * 9/1958 Goodloe
5,727,278 A * 3/1998 Per-Lee
6,131,234 A * 10/2000 Chen
6,439,144 B1 * 8/2002 Chen
2002/0152571 A1 * 10/2002 Lee

* cited by examiner

*Primary Examiner*—Randall E. Chin

(57) ABSTRACT

A comfortable bathing scrubber includes a tubular flexible mesh member which is corrugated sinuously, stitched and fastened with a pair of elastic bands or strips longitudinally about a longitudinal axis of the tubular mesh member and then wound to form an annular ring member of the flexible mesh member, of which two opposite ends of the ring member are finally tied or fastened to obtain a spherical bathing scrubber for comfortably bathing or rubbing a user's body without scratching or injuring her or his skin.

3 Claims, 2 Drawing Sheets

METHOD FOR MAKING COMFORTABLE BATHING SCRUBBER

BACKGROUND OF THE INVENTION

U.S. Pat. No. 5,740,599 to James Chang disclosed a method for making a cleaning scrubber having a pair of elastic cords (16) fastened on opposite ends of a reticulate tube (12) for forming the cleaning scrubber. However, the two cords (16) as fastened on opposite ends (especially as shown in FIG. 4 of the prior art) of the tube (12) will form a pair of knots disposed on a periphery of the spherical cleaning scrubber to easily scratch a user's soft skin to cause injury by the "knots" of the cords (16) when using such a scrubber for taking a bath. Meanwhile, it does not provide a central hollow portion in the spherical scrubber adapted for user's gripping.

The present inventor has found the drawbacks of the conventional scrubber and invented the present comfortable bathing scrubber.

SUMMARY OF THE INVENTION

The object of the present invention is to provide a comfortable bathing scrubber including a tubular flexible mesh member which is corrugated sinuously, stitched and fastened with a pair of elastic bands or strips longitudinally about a longitudinal axis of the tubular mesh member and then wound to form an annular ring member of the flexible mesh member, of which two opposite ends of the ring member are finally tied or fastened to obtain a spherical bathing scrubber for comfortably rubbing and bathing a user's body without scratching or injuring her or his skin.

DETAILED DESCRIPTION

Figure 1:
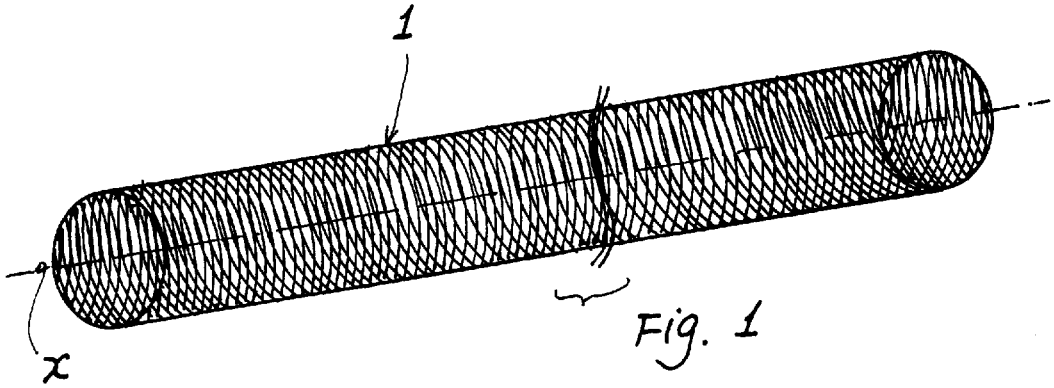
FIG. 1 is a perspective view of a tubular mesh member of the present invention.

As shown in the drawing figures, a method for making a comfortable bathing scrubber in accordance with the present invention comprises the steps including:

A. The first step is to form an elongate tubular flexible or soft mesh member 1 which may be made of Nylon, fibers, cloth or other plastic materials having porosity formed in the mesh or net member.

Figure 2:
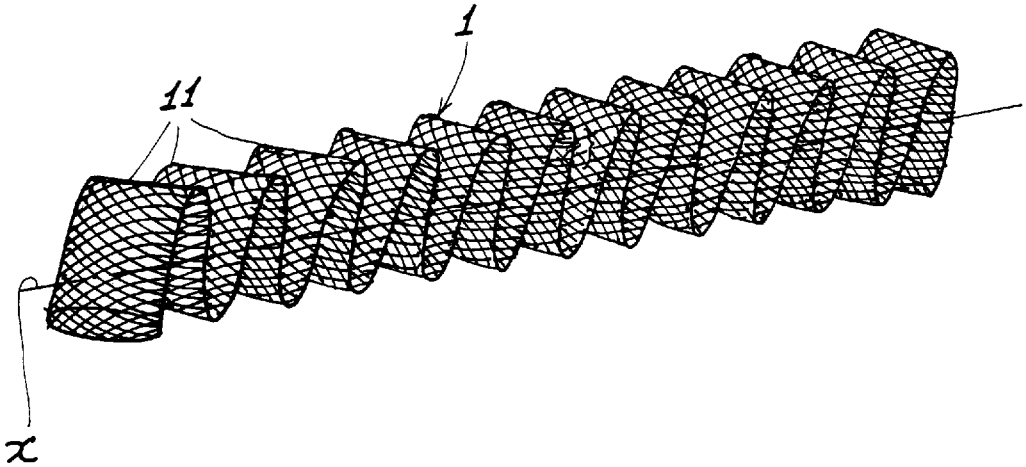
FIG. 2 shows a corrugated mesh member after sinuously corrugating or folding the tubular mesh member as shown in FIG. 1.

B. Along a longitudinal axis X defined at a longitudinal center of the tubular mesh member 1 (FIG. 1), the tubular mesh member 1 is sinuously corrugated or folded to form a corrugated mesh member as shown in FIG. 2 consisting of a plurality of corrugations 11.

Figure 3:
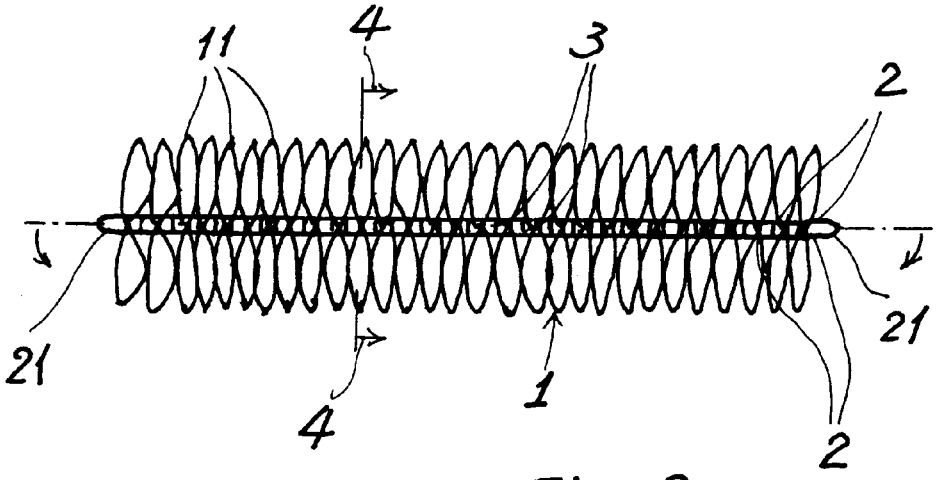
FIG. 3 is a front view when fastening a pair of elastic bands on the corrugated mesh member as shown in FIG. 2.

C. Fastening or stitching a pair of elastic bands or elastic fastening strips 2 as shown in FIG. 3 on the corrugated mesh member 1 from a top and a bottom side of the corrugated mesh member as folded from FIG. 2 to approximate the elastic bands or strips 2 to be contiguous to the longitudinal axis X of the tubular mesh member 1 (FIG. 4) by sewing threads (stitching) 3 on the elastic bands lengthwise along the longitudinal axis X of the mesh member 1.

Figure 4:
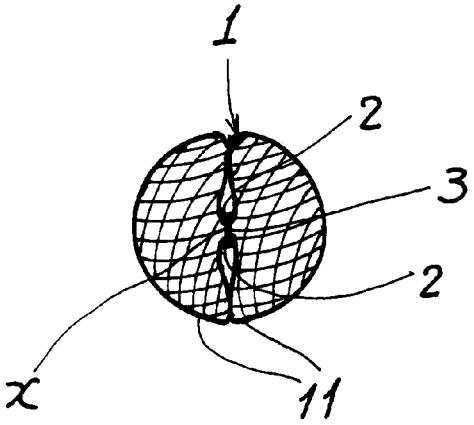
FIG. 4 is a cross sectional drawing as viewed from 4—4 direction of FIG. 3.

After sewing or stitching (3) the elastic bands 2 on the corrugated mesh member 1, a cross section of generally circular shape of the corrugated mesh member 1 will be formed as shown in FIG. 4 to form a "basic unit" of rubbing or scrubbing unit of a cleaning or bathing scrubber.

Figure 5:
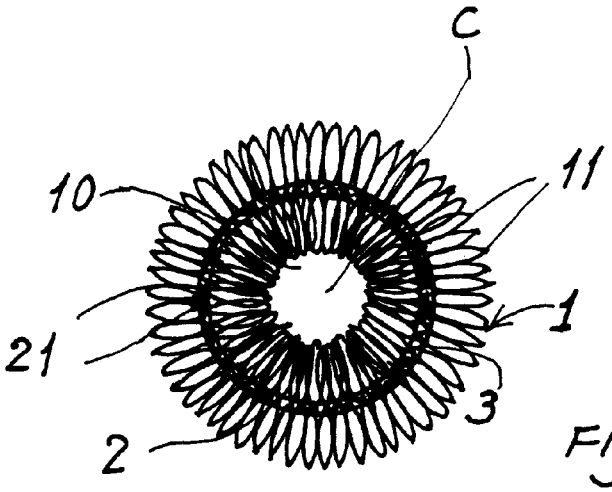
FIG. 5 shows a spherical bathing scrubber in accordance with the present invention.

D. The elongate corrugated mesh member 1, after being fastened by the elastic bands 2 as shown in FIGS. 3, 4, is now wound to form an annular ring member about a center C of the ring member as shown in FIG. 5. Finally, two opposite free ends 21, 21 of the corrugated mesh member 1 are fastened as shown in FIG. 5 to obtain the spherical bathing scrubber for bathing or rubbing purpose.

By inserting a user's hand into the central opening 10 (FIG. 5), the spherical bathing scrubber will then be resiliently fastened on the user's hand for bathing operation.

The present invention is superior to the conventional cleaning scrubber with the following advantages:

1. The elastic bands 2 are fastened to closely approximate the center C of the spherical bathing scrubber, thereby being unable to scratch or injure the user's body skin for enhancing a comfortable bathing.
2. The elastic bands 2 for fastening the mesh member 1 will increase the resilient fastening of the ring-shaped bathing scrubber (FIG. 5) for a firm fastening of the scrubber on a user's hand for a more ergonomic bathing. The central opening 10 may be conveniently inserted by the user's hand for a stable holding of the scrubber.

The present invention may be modified without departing from the spirit and scope of this invention.

The present invention also includes. the product of bathing scrubber as made according to the method as aforementioned.

I claim:

1. A method for making a comfortable bathing scrubber comprising the steps including:

A. Forming an elongate tubular flexible mesh member having porosity formed in the mesh member;

B. Sinuously corrugating and folding said tubular mesh member along a longitudinal axis defined at a longitudinal center of the tubular mesh member to form a corrugated mesh member consisting of a plurality of corrugations;

C. Fastening a pair of elastic bands on the corrugated mesh member from a top and a bottom side of the corrugated mesh member as folded to approximate the elastic bands to be contiguous to the longitudinal axis of the tubular mesh member lengthwise along the longitudinal axis of the mesh member; and D. Winding the elongate corrugated mesh member, after being fastened by the elastic bands, to form an annular ring member about a center of the ring member; and fastening two opposite free ends of the corrugated mesh member to obtain a spherical bathing scrubber.

2. A method according to claim 1, wherein the step for fastening the pair of elastic bands on the corrugated mesh member includes stitching the pair of elastic bands on said corrugated mesh member.

3. A bathing scrubber as made in accordance with the method as set forth in claim 1.

* * * * *